US011458701B2

(12) United States Patent
Grotebevelsborg

(10) Patent No.: US 11,458,701 B2
(45) Date of Patent: Oct. 4, 2022

(54) DEVICE AND METHOD FOR PRESSING ORGANIC MATERIAL OUT OF WASTE

(71) Applicant: ANAERGIA B.V., Oldenzaal (NL)

(72) Inventor: Willem Jan Oude Grotebevelsborg, Oldenzaal (NL)

(73) Assignee: ANAERGIA B.V., Oldenzaal (NL)

( * ) Notice: Subject to any disclaimer, the term of this patent is extended or adjusted under 35 U.S.C. 154(b) by 950 days.

(21) Appl. No.: 14/684,127

(22) Filed: Apr. 10, 2015

(65) Prior Publication Data

US 2015/0283779 A1 Oct. 8, 2015

Related U.S. Application Data

(63) Continuation-in-part of application No. PCT/NL2014/000026, filed on Aug. 28, 2014.
(Continued)

(30) Foreign Application Priority Data

Oct. 13, 2013 (NL) ..... 1040442

(51) Int. Cl.
*B30B 9/30* (2006.01)
*B30B 9/06* (2006.01)

(52) U.S. Cl.
CPC ..... *B30B 9/3039* (2013.01); *B30B 9/06* (2013.01); *B30B 9/067* (2013.01); *B30B 9/301* (2013.01);
(Continued)

(58) Field of Classification Search
CPC ..... B30B 9/067; B30B 9/3078; B30B 9/3039; B30B 9/06; B30B 9/3021; B30B 9/065; B30B 7/04
(Continued)

(56) References Cited

U.S. PATENT DOCUMENTS 1,014,893 A 1/1912 Henry
1,328,259 A 1/1920 Barbet
(Continued)

FOREIGN PATENT DOCUMENTS

CA 1117851 A1 2/1982
CA 2343832 A1 10/2002
(Continued)

OTHER PUBLICATIONS

Machine Translation of DE 3113515, Retrieved from Espacenet Apr. 1, 2021, 4 Pages. (Year: 1982).*
(Continued)

*Primary Examiner* — Gregory D Swiatocha
(74) *Attorney, Agent, or Firm* — Greer, Burns & Crain, Ltd

(57) ABSTRACT

A press for processing organic waste has two plungers. Preferably, the plungers have rectangular cross sections. The two plungers are mounted in the press such that they are perpendicular to each other and have partially overlapping stokes. The press has walls that partially enclose a pressing chamber. The pressing chamber is as wide as one plunger on one side, and as wide as the other plunger on another side. In operation, one of the two plungers is used to optionally load organic waste into the pressing chamber, to partially enclose the pressing chamber while the waste is compressed, and to eject compressed waste from the pressing chamber. The other plunger is used to compress waste in the pressing chamber whereby a pressate is produced through perforations in a wall of the pressing chamber. The other plunger may also partially enclose the pressing chamber while compressed waste is ejected.

11 Claims, 8 Drawing Sheets

Related U.S. Application Data

(60) Provisional application No. 62/044,625, filed on Sep. 2, 2014.

(52) U.S. Cl.
CPC ..... *B30B 9/3014* (2013.01); *B30B 9/3021* (2013.01); *B30B 9/3028* (2013.01); *B30B 9/3078* (2013.01)

(58) Field of Classification Search
USPC ..... 100/37
See application file for complete search history.

(56) References Cited

U.S. PATENT DOCUMENTS 2,000,444 A 5/1935 Hechenbleikner
2,289,953 A 7/1942 Aldridge
2,854,827 A 10/1958 Lockerbie et al.
2,937,506 A 5/1960 Stirlen
3,005,403 A 10/1961 Endert
3,255,887 A 6/1966 Walker et al.
3,365,860 A 1/1968 Boris
3,451,185 A 6/1969 Kunitoshi
3,491,682 A 1/1970 Nils et al.
3,517,732 A 6/1970 Robert
3,618,905 A 11/1971 Primus
3,858,504 A 1/1975 Boyer
3,864,440 A 2/1975 Giocoechea
4,036,356 A 7/1977 Reist
4,036,359 A * 7/1977 Strickland, Jr. ..... B30B 9/3039 100/37
4,098,690 A 7/1978 Semmens
4,121,515 A * 10/1978 Tea ..... B30B 9/3003 100/189
4,162,147 A 7/1979 Haverkamp
4,198,359 A 4/1980 Todd
4,232,600 A * 11/1980 Le Jeune ..... B02C 19/00 100/37
4,294,812 A 10/1981 Oler
4,343,233 A 8/1982 Burgin
4,414,103 A 11/1983 Farrell
4,417,510 A 11/1983 Sharp
4,477,341 A 10/1984 Schweiss et al.
4,594,942 A * 6/1986 Denneboom ..... B30B 9/3078 100/137
4,613,431 A 9/1986 Miller
4,618,462 A 10/1986 Fisher
4,650,546 A * 3/1987 Le Jeune ..... B09B 3/00 201/6
4,691,628 A 9/1987 Simpson
4,770,748 A 9/1988 Cellini et al.
4,861,524 A 8/1989 Sielaff et al.
4,880,504 A 11/1989 Cellini et al.
5,030,362 A 7/1991 Da et al.
5,146,848 A 9/1992 Dufour
5,203,261 A * 4/1993 Davis ..... B30B 9/3078 100/215
5,273,572 A 12/1993 Baker et al.
5,400,726 A 3/1995 Dumons
5,458,789 A 10/1995 Dickerson et al.
5,593,590 A 1/1997 Steyskal
5,863,444 A 1/1999 Murphy et al.
6,139,601 A * 10/2000 Wernimont ..... B30B 9/3039 100/37
6,149,887 A 11/2000 Lagas et al.
6,162,284 A 12/2000 Mitchell et al.
6,178,822 B1 1/2001 Manning
6,178,882 B1 * 1/2001 Wagner ..... B09B 3/0058 100/240
6,299,774 B1 10/2001 Ainsworth et al.
6,368,849 B1 4/2002 Norddahl
6,383,544 B1 5/2002 Elkins
6,409,788 B1 6/2002 Sower
6,464,875 B1 10/2002 Woodruff
6,569,332 B2 5/2003 Ainsworth et al.
6,682,578 B2 1/2004 Sower
6,692,642 B2 2/2004 Josse et al.
6,715,743 B2 4/2004 Zhang
6,838,069 B2 1/2005 Blonigen et al.
6,846,343 B2 1/2005 Sower
6,866,779 B1 3/2005 Burke
6,916,426 B2 7/2005 Van et al.
6,920,983 B2 7/2005 Gabl
6,984,323 B2 1/2006 Khudenko
6,994,021 B2 2/2006 Krammer
7,014,768 B2 3/2006 Li et al.
7,153,427 B2 12/2006 Burke
7,204,967 B2 4/2007 Bierle et al.
7,416,644 B2 8/2008 Bonde
7,731,850 B2 6/2010 Choi et al.
7,806,957 B1 10/2010 Burke
7,814,826 B2 * 10/2010 Ribas-Blanes ..... B30B 9/3003 100/126
7,927,491 B2 4/2011 Kotelko et al.
8,470,567 B2 6/2013 Facey et al.
9,045,355 B2 6/2015 Kumar et al.
2001/0004063 A1 6/2001 Oh
2001/0033816 A1 10/2001 Blonigen et al.
2002/0134254 A1 9/2002 Sebright et al.
2002/0158024 A1 10/2002 Van et al.
2003/0084693 A1 5/2003 Sower
2003/0201225 A1 10/2003 Josse et al.
2004/0164021 A1 8/2004 Li et al.
2005/0047995 A1 3/2005 Wylie
2005/0139546 A1 6/2005 Burke
2006/0006055 A1 1/2006 Bonde
2007/0048212 A1 3/2007 Bierle et al.
2007/0141691 A1 6/2007 Hirl
2007/0297953 A1 12/2007 Kemp et al.
2008/0053909 A1 3/2008 Fassbender
2008/0053913 A1 3/2008 Fassbender
2008/0152571 A1 6/2008 Hu et al.
2008/0156709 A1 7/2008 Johnson
2008/0156726 A1 7/2008 Fassbender
2008/0302722 A1 12/2008 Burke
2009/0014377 A1 1/2009 Janssen et al.
2009/0095673 A1 4/2009 Choate et al.
2009/0206028 A1 8/2009 Jiang et al.
2009/0272282 A1 * 11/2009 Fortier ..... B30B 9/3003 100/249
2010/0065250 A1 3/2010 Frommann
2010/0170845 A1 7/2010 Baur et al.
2010/0187182 A1 7/2010 Vago
2010/0218573 A1 9/2010 Van
2011/0091954 A1 4/2011 Chen et al.
2012/0122194 A1 5/2012 Dumons
2013/0316428 A1 * 11/2013 Gonella ..... C12M 21/04 435/170
2014/0033776 A1 2/2014 Josse et al.
2014/0144195 A1 5/2014 Callendrello et al.
2014/0157846 A1 6/2014 Jeppson et al.
2014/0314657 A1 10/2014 Zhao et al.
2017/0334739 A1 11/2017 Theodoulou et al.

FOREIGN PATENT DOCUMENTS

CA 2381623 A1 10/2002
CA 2416690 A1 7/2004
CA 2416690 C 8/2008
CA 2799408 A1 11/2011
CH 655048 A5 3/1986
CN 201841684 U 5/2011
CN 101683771 B 12/2011
CN 102442011 A 5/2012
DE 2726233 A1 12/1978
DE 2841015 A1 4/1980
DE 8103406 U1 4/1981
DE 3113515 A1 * 11/1982 ..... B30B 9/067
DE 4444032 C1 5/1996
DE 102008007818 A1 8/2009
DE 102009058166 A1 6/2011
EP 0043770 A1 1/1982
EP 0091365 A1 10/1983

(56) References Cited

FOREIGN PATENT DOCUMENTS

| | | | | |
|---|---|---|---|---|
| EP | 0468852 | A1 | 1/1992 | |
| EP | 0468853 | A1 | 1/1992 | |
| EP | 0494561 | A1 | 7/1992 | |
| EP | 0494154 | B1 | 9/1995 | |
| EP | 1215187 | A2 | 6/2002 | |
| EP | 1273393 | A2 | 1/2003 | |
| EP | 1173325 | B1 | 7/2003 | |
| EP | 1568478 | A1 | 8/2005 | |
| EP | 2014455 | A1 | 1/2009 | |
| EP | 2335914 | A2 | 6/2011 | |
| EP | 2344284 | B1 | 8/2016 | |
| FR | 2510474 | A1 | 2/1983 | |
| FR | 2615443 | A1 | 11/1988 | |
| FR | 2677579 | A1 | 12/1992 | |
| GB | 710383 | A | 6/1954 | |
| GB | 2139610 | A | 11/1984 | |
| GB | 2383034 | A | 6/2003 | |
| IT | TO20111068 | A1 | 5/2013 | |
| JP | S5533900 | A | 3/1980 | |
| JP | H069793 | U | 2/1994 | |
| JP | 4678751 | B2 * | 4/2011 | ..... B30B 9/327 |
| WO | 9942423 | A1 | 8/1999 | |
| WO | 2009011906 | A1 | 1/2009 | |
| WO | 2010096899 | A1 | 9/2010 | |
| WO | 2010097177 | A1 | 9/2010 | |
| WO | WO 2010097177 | A1 * | 9/2010 | ..... B09B 3/0025 |
| WO | 2011156767 | A2 | 12/2011 | |
| WO | 2012109737 | A1 | 8/2012 | |
| WO | 2013091094 | A1 | 6/2013 | |
| WO | 2014094162 | A1 | 6/2014 | |

OTHER PUBLICATIONS

Machine Translation of JP 4678751, Retrieved from Espacenet Apr. 1, 2021, 13 Pages. (Year: 2011).*

Ammonia Recovery Process, http://www.thermoenergy.com/water-technologies/, retrieved on line 2011, 1 page.

Bonmati et al., "Air Stripping of Ammonia From Pig Slurry: Characterisation and Feasibility as a Pre- or Post-Treatment to Mesophilic Anaerobic Digestion," Waste Management, 2003, vol. 23 (3), pp. 261-272.

Canadian Patent Application No. 2,826,025, Office Action dated Oct. 16, 2017.

Cast Systems, www.thermoenergy.com/water-technologies/technologies . . . , 2011, retrieved from the Internet Nov. 2, 2011, 1 Page.

CASTion Corporation, A Thermo Energy Company, "Ammonia Removal in Municipal Sludge Dewatering Centrate," Pilot Test Results on Centrate, Dec. 1, 2008, 16 Pages.

Chinese Patent Application No. 201480062263.3, Office Action dated Jul. 9, 2018—English Translation Available.

Chinese Patent Application No. 201480062263.3, Office Action dated Dec. 13, 2017—English Translation Available.

Chinese Patent Application No. 201480062263.3, Office Action dated Jun. 12, 2017 with English Translation.

Chinese Patent Application No. 201480062263.3, Office Action dated Oct. 9, 2016—with English Translation.

Chinese Patent Application No. 201480062263.3, Third Office Action dated Dec. 29, 2017—English Translation Available.

Constantine, "An Overview of Ammonia and Nitrogen Removal in Wastewater Treatment", CH2M Hill Canada, Feb. 19, 2008.

Constantine, "North American Experience with Centrate Treatment Technologies for Ammonia and Nitrogen Removal," WEFTEC Conference, 2006, pp. 5271-5281.

Dhaliwal et al., "Distillation of Ammonia from Water and Wastewater," Water Pollution Control Federation, Oct. 1985, vol. 57 (10), pp. 1036-1039.

EPA, "Wastewater Technology Fact Sheet Ammonia Stripping," United States Environmental Protection Agency, Sep. 2000, 4 pages.

European Patent Application No. 12746463.4, Examination Report dated Jun. 21, 2018.

European Application No. 12860692, Supplementary European Search Report dated Jul. 16, 2015.

European Application No. 13866334.9, Supplementary Partial European Search Report dated Feb. 20, 2017.

European Application No. 13866334.9, Supplementary Partial European Search Report dated Oct. 21, 2016.

European Patent Application No. 12746463.4 Communication pursuant to Rule 70(2) and 70a(2) EPC dated Jul. 7, 2017.

European Patent Application No. 12746463.4, Extended European Search Report dated Jun. 21, 2017.

European Patent Application No. 12860692.8, Office Action dated Dec. 12, 2016.

European Patent Application No. 12860692.8, Office Action dated Jan. 4, 2018.

European Patent Application No. 15857098.6, Extended European Search Report dated Jun. 6, 2018.

European Patent Application No. 16177423.7, European Search Report dated Dec. 5, 2016.

Fernandez-Seara et al., "Distillation Column Configurations in Ammonia-Water Absorption Refrigeration Systems," International Journal of Refrigeration, Jan. 2003, vol. 26 (1), pp. 28-34.

Groth et al., English Language Abstract of DE4444032 entitled "Manure treatment in two stages, to release ammonia and concentrate slurry", published May 2, 1996, 1 page.

International Patent Application No. PCT/CA2012/000144, International Preliminary Reporton Patentability dated Aug. 29, 2013.

International Patent Application No. PCT/CA2012/000144, International Search Report dated Jul. 10, 2012.

International Patent Application No. PCT/CA2012/050907, International Preliminary Report on Patentability dated Jul. 3, 2014.

International Patent Application No. PCT/CA2012/050907, International Search Report dated Mar. 25, 2013.

International Patent Application No. PCT/CA2013/050985, International Preliminary Report on Patentability dated Jul. 2, 2015.

International Patent Application No. PCT/CA2013/050985, International Search Report and Written Opinion dated Apr. 24, 2014.

International Patent Application No. PCT/CA2015/051154, International Search Report and Written Opinion dated Jan. 25, 2016.

International Patent Application No. PCT/NL2014/000026, International Preliminary Reporton Patentability dated Apr. 28, 2016.

International Patent Application No. PCT/NL2014/000026, International Search Report and Written Opinion dated Dec. 5, 2014.

Jorgensen et al., "Ammonia Removal from Wastewater by Ion Exchange in the Presence of Organic Contaminants," Water Research, 2003, vol. 37, pp. 1723-1728.

Netherland Patent Application No. 1040442, Search Report dated Apr. 16, 2014—No English Translation Available.

Office Action for Canadian Application No. 20142926816 dated May 1, 2017.

Oilgae, "New Technologies in Ammonia Removal from Wastewater", http://www.oilge.com/algae/cult/sew/new/amm/amm.html, retrieved online Dec. 14, 2011, 10 Pages.

Orentlicher et al., "Savings from Integration of Centrate Ammonia Reduction with BNR Operation: Simulation of Plant Operation," ThermoEnergy Corporation, HydroQual Inc., undated, 25 pages, http://web2.uconn.edu/seagrantnybight/documents/nutrient%20docs/Orentlicher%20Savings%20Integration%20Centrate%20Ammonia%20Reduction.pdf.

Thermoenergy, Ammonia Removal and Recovery Systems for Industrial Wastewater Treatment, http://www.thermoenergy.com/water-technologies/industrial-solutions/ammonia-removal . . . , retrieved online Dec. 14, 2011, 2 Pages.

U.S. Appl. No. 15/209,293, Non-Final Office Action dated May 14, 2018.

U.S. Appl. No. 13/823,404, Final Office Action dated Feb. 9, 2016.

U.S. Appl. No. 13/823,404, Office Action dated Feb. 13, 2015.

U.S. Appl. No. 13/823,404, Office Action dated May 21, 2015.

U.S. Appl. No. 13/982,585, Office Action dated Dec. 14, 2015.

U.S. Appl. No. 13/982,585, Office Action dated Sep. 18, 2015.

U.S. Appl. No. 14/652,615, Final Office Action dated Jun. 7, 2017.

(56) References Cited

OTHER PUBLICATIONS

U.S. Appl. No. 14/652,615, Notice of Allowance dated Jul. 21, 2017.
U.S. Appl. No. 14/652,615, Office Action dated Feb. 10, 2017.
U.S. Appl. No. 14/934,780, Non-Final Office Action dated Dec. 15, 2017.
U.S. Appl. No. 14/934,780, Notice of Allowance dated Apr. 5, 2018.
U.S. Appl. No. 14/934,780, Restriction Requirement dated Sep. 14, 2017.
U.S. Appl. No. 15/027,885, Final Office Action dated Apr. 4, 2018.
U.S. Appl. No. 15/027,885, Non-Final Office Action dated Jun. 15, 2017.
U.S. Appl. No. 15/209,293, Restriction Requirement dated Feb. 16, 2018.
U.S. Appl. No. 15/360,574, Non-Final Office Action dated Feb. 8, 2018.
U.S. Appl. No. 15/475,028, Non-Final Office Action dated Jan. 25, 2018.
Written Opinion for Application No. PCT/CA2012/000144, dated Jul. 10, 2012, 5 pages.
Written Opinion for Application No. PCT/CA2012/050907, dated Mar. 25, 2013, 10 pages.
Written Opinion for Application No. ITTO20111068, dated Apr. 26, 2012, 9 pages.
U.S. Appl. No. 15/475,028, Final Office Action dated Sep. 21, 2018.
U.S. Appl. No. 15/027,885, Non-Final Office Action dated Dec. 14, 2018.
Canadian Patent Application No. 2,926,816, Office Action dated Dec. 11, 2018.
Canadian Patent Application No. 2,926,816, Office Action dated Oct. 4, 2019.
Chinese Patent Application No. 201480062263.3, Office Action dated Aug. 22, 2019.
Chinese Patent Application No. 201480062263.3, Office Action dated May 8, 2019.
U.S. Appl. No. 14/934,780, Notice of Allowance dated Dec. 13, 2018.
U.S. Appl. No. 15/027,885, Final Office Action dated Aug. 19, 2019.
U.S. Appl. No. 15/524,886, Non Final Office Action dated Feb. 20, 2019.
U.S. Appl. No. 14/934,780, Non-Final Office Action dated Jul. 26, 2018.
U.S. Appl. No. 15/209,293, Final Office Action dated Dec. 14, 2018.
U.S. Appl. No. 15/360,574, Final Office Action dated Oct. 31, 2018.
U.S. Appl. No. 15/360,574, Notice of Allowance dated Dec. 12, 2018.
U.S. Appl. No. 15/475,028, Non-Final Office Action dated Jul. 23, 2019.
Chinese Patent Application No. 201480062263.3, Office Action dated Jan. 9, 2020.
Indian Patent Application No. 201617014280, Office Action dated Dec. 31, 2019.
United Kingdom Patent Application No. 1608258.8, Examination Report dated Dec. 3, 2019.
U.S. Appl. No. 15/475,028, Final Office Action dated Jan. 8, 2020.
U.S. Appl. No. 15/027,885, Notice of Allowance dated Nov. 8, 2019.
Canadian Patent Application No. 2,826,025, Office Action dated Jul. 3, 2018.
Canadian Patent Application No. CA2926816, Office Action dated Sep. 15, 2020.
European Application No. 14786373.2, Communication pursuant to Article 94(3), dated Jan. 14, 2021.
European Application No. 16177423.7, Communication pursuant to Article 94(3), dated Aug. 23, 2018.
European Patent Application No. 14786373.2, Office Action dated May 14, 2020.
U.S. Appl. No. 15/475,028, Non-Final Office Action dated Nov. 16, 2020.
United Kingdom Patent Application No. 1608258.8, Examination Report dated Mar. 6, 2020.
United Kingdom Patent Application No. 1608258.8, Search and Examination Report dated Jul. 29, 2020.
Office Action received in Chinese Application No. 202010939317.7, dated Jan. 5, 2022.
Office Action received for Canadian Application No. 2,926,816 dated, May 5, 2021.
Office Action received for Canadian Application No. 2,926,816, dated Sep. 15, 2020.
Office Action received for European Application No. 14786373.2, dated Aug. 25, 2021.
Office Action received for European Application No. 14786373.2, dated Jan. 14, 2021.

* cited by examiner

DEVICE AND METHOD FOR PRESSING ORGANIC MATERIAL OUT OF WASTE

RELATED APPLICATIONS

This application claims the benefit of U.S. Provisional Application No. 62/044,625 filed on Sep. 2, 2014; and is a continuation-in-part of PCT Application No. PCT/NL2014/000026 filed on Aug. 28, 2014 which claims priority to Dutch Application No. NL 1040442 filed Oct. 13, 2013. U.S. Provisional Application No. 62/044,625; PCT Application No. PCT/NL2014/000026; and Dutch Application No. NL 1040442 are incorporated by reference.

FIELD

This specification relates to devices and processes for pressing waste, in particular for pressing organic waste at a pressure higher than the bursting pressure of biological cells.

BACKGROUND

The following background description is not an admission that anything described below is common general knowledge or citable prior art.

Municipal solid waste (MSW) typically contains inert material, such as plastic, glass and metal, as well as an organic fraction made up of, for example, food waste and garden waste. In some cases, organic waste is collected separately from households. In other cases, inert material may be separated from organic waste at a central facility. Overall, waste streams may be created that consist entirely, or at least primarily, of organic waste or that have an organic fraction mixed with inert material. Agricultural and industrial waste may also consist of organic waste, or may have an organic fraction mixed with inert material.

The organic waste can be processed by anaerobic digestion. US Publication No. 2013/0316428 describes a process of pressing organic waste through a grid of small bore holes under a pressure higher than the bursting pressure of the cell membranes. The bursting pressure is typically about 50 bar. A pressate gel of doughy consistency is produced and loaded into an anaerobic digester. The press may be as described in European Publication Nos. 1207040 and 1568478. In general, these presses use a plunger to compress waste that has been loaded into a cylinder. The sides of the cylinder are perforated with radial holes.

SUMMARY OF THE INVENTION

The following summary is intended to introduce the reader to the detailed description that follows, and not to limit or define any claimed invention.

A press described in this specification has two plungers. Preferably, the plungers have rectangular cross sections. The two plungers are mounted in the press such that they are perpendicular to each other in a plane and have partially overlapping stokes. The press also has walls that partially enclose a pressing chamber. The pressing chamber covers a rectangular area of the plane that is as wide as one plunger on one side of the rectangle, and as wide as the other plunger on the other side of the rectangle.

In operation, one of the two plungers is used to partially enclose the pressing chamber while the waste is compressed, to eject compressed waste from the pressing chamber and, optionally, to load organic waste into the pressing chamber. The other plunger is used to compress waste in the pressing chamber. The other plunger may also partially enclose the pressing chamber while compressed waste is ejected.

DETAILED DESCRIPTION

Figure 14:
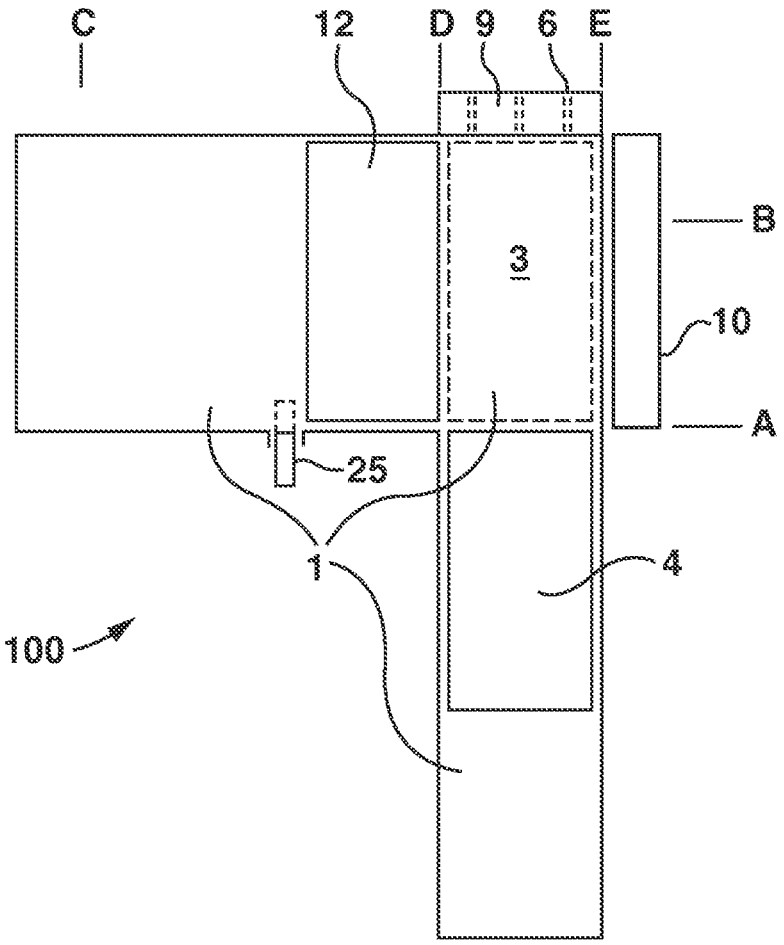
FIG. 14 is a schematic drawing showing the general arrangement of a press in plan (top) view.

FIG. 14 shows a schematic representation of a press 100. For the purposes of this description, FIG. 14 will be assumed to be a plan view, although the press 100 can be used in different orientations.

Figure 1:
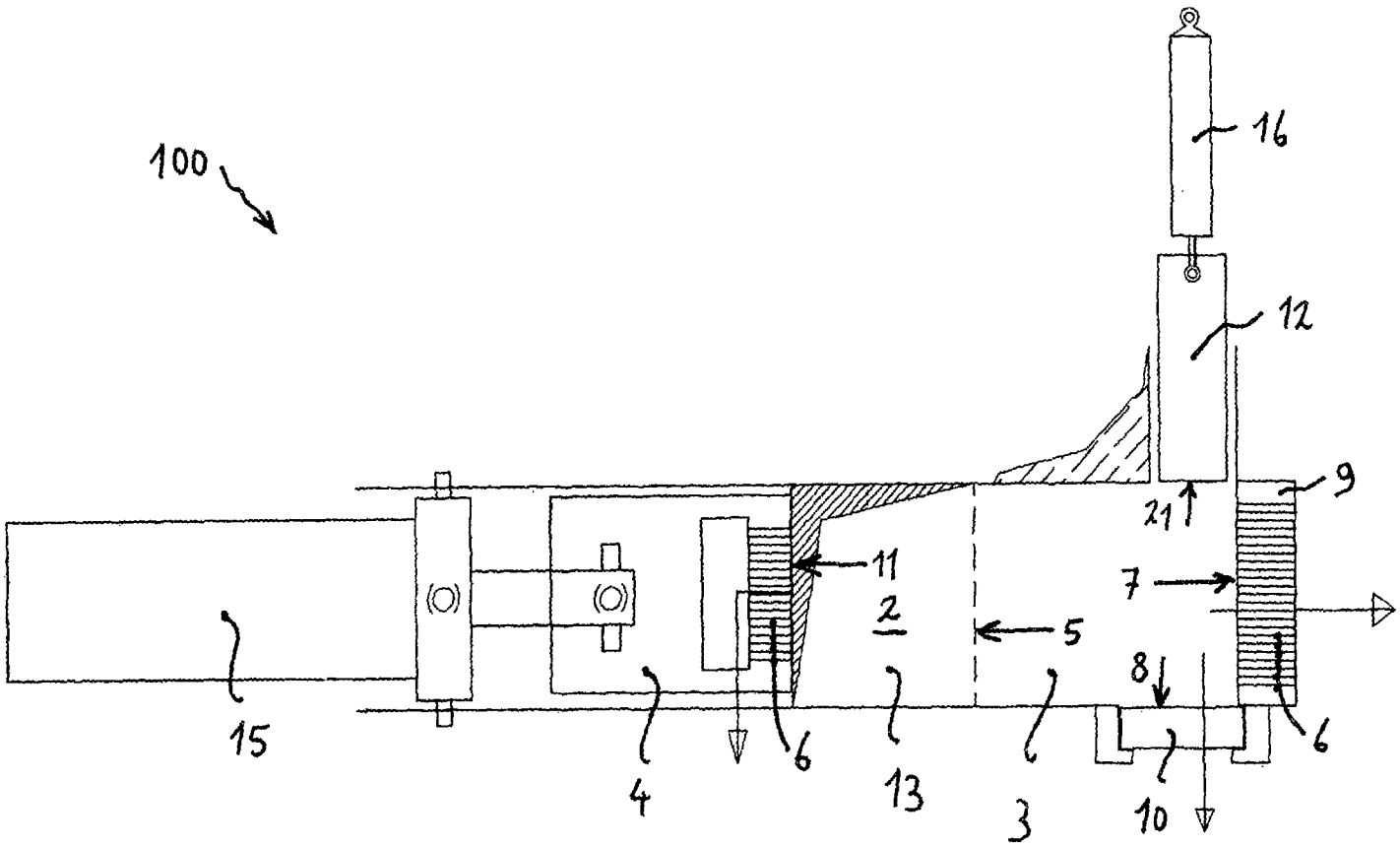
FIG. 1 shows a horizontal longitudinal section of a first press.
Figure 2:
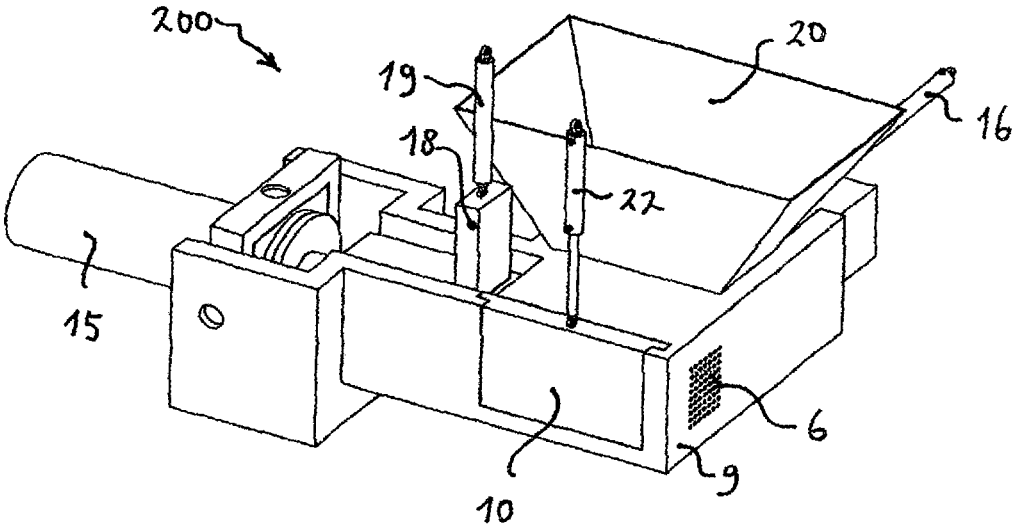
FIG. 2 is a perspective view of a second press.
Figure 3:
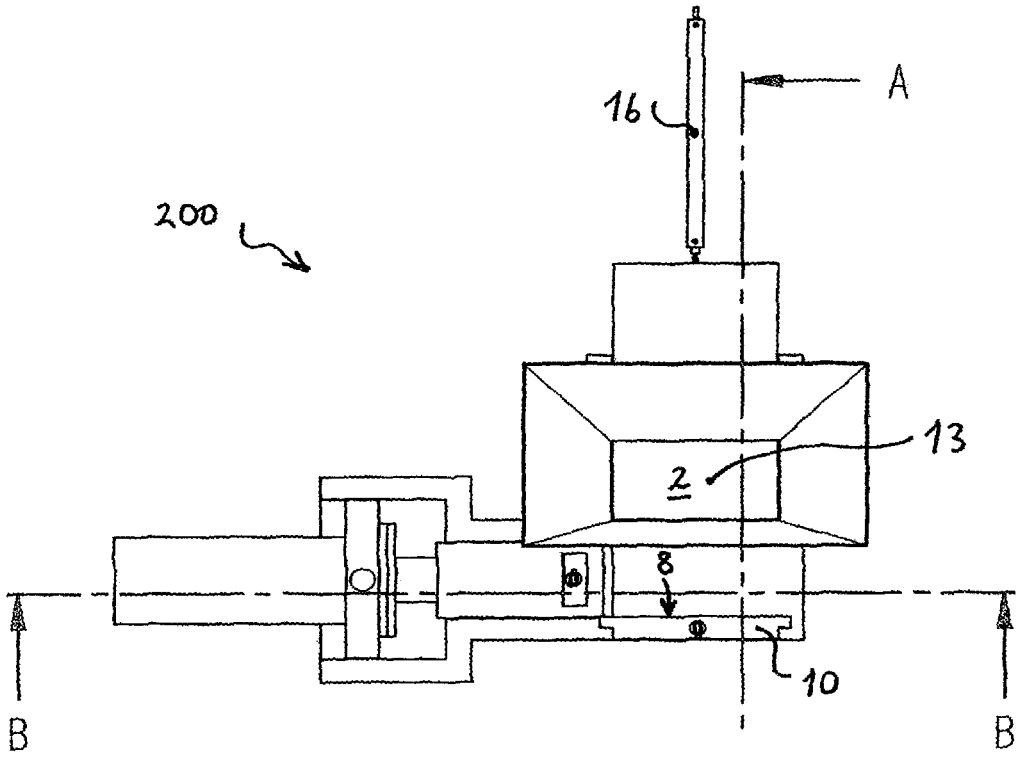
FIG. 3 is a top view of the press of FIG. 2.
Figure 4:
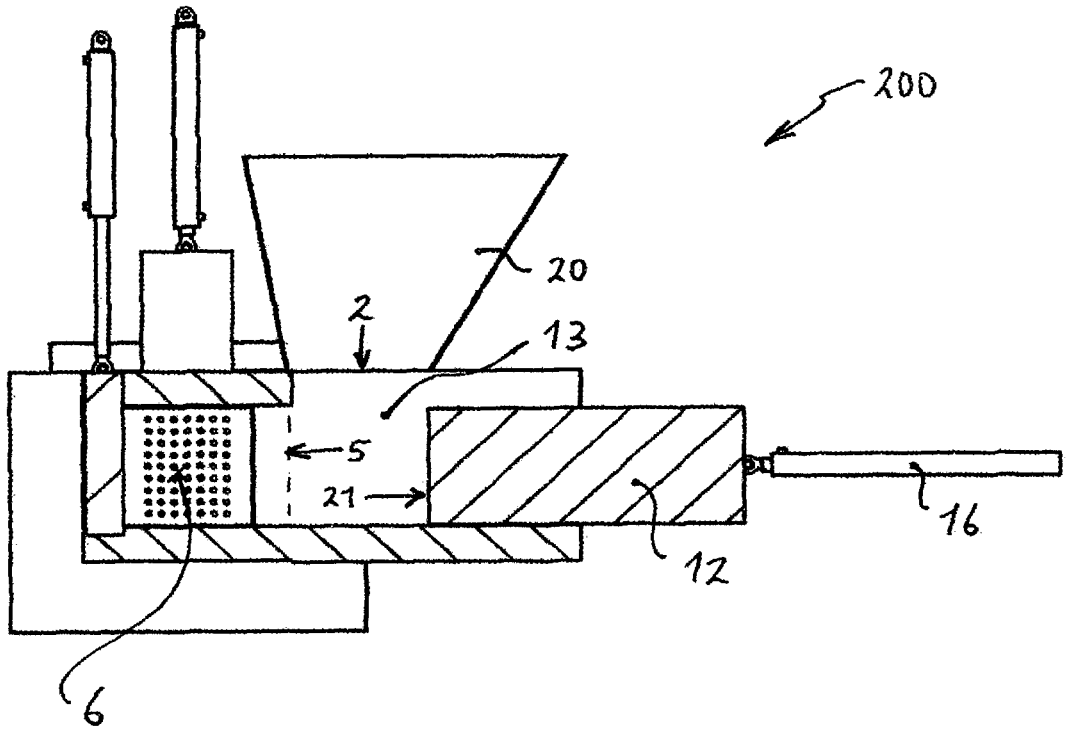
FIG. 4 is a vertical section of the press of FIG. 2 along the plane A-A.

The press 100 has a frame 1, only parts of which are shown in FIG. 1 to simplify the drawing. The frame 1 provides the bottom wall of a pressing chamber 3. The frame 1 also typically provides a top wall of the pressing chamber 3, which is not shown in FIG. 14. The pressing chamber 3 has a volume defined approximately by the area within the dashed rectangle shown in FIG. 14 multiplied by the height of the pressing chamber 3, which is the distance between the top and bottom surfaces of the pressing chamber 3.

Optionally, the frame 1 also extends outwards from the pressing chamber 3 to support a first plunger 4 and a second plunger 12. The first plunger 4 and the second plunger 12 each have a height essentially equal to the height of the pressing chamber 3. The precise height of the plungers 4, 12 is reduced relative to the height of the pressing chamber 3 to provide a tolerance and allow the plungers 4, 12 to move into the pressing chamber 3 from the positions shown in FIG. 14. The stroke of the first plunger 4 is perpendicular to the stroke of the second plunger 12. The first plunger 4 and the second plunger 12 can not both be moved into the pressing chamber 3 at the same time since their strokes at least partially overlap.

The frame 1 includes a wall 9 that provides an end wall of the pressing chamber 3. A door, preferably a sliding door 10, is available to selectively provide a wall on one side of the pressing chamber 3. When the first plunger 4 and the second plunger 12 are positioned as shown in FIG. 14, they provide another end wall and side wall of the pressing chamber 3. The second plunger 12 is preferably wider than the first plunger 4, which causes the pressing chamber 3 to be elongate. However, the pressing chamber 3 could also be square.

As shown in FIG. 14, the pressing chamber 3 is fully enclosed but for perforations 6 and various small gaps between components of the press 100. At other times, for example when the second plunger 12 is retracted and the sliding door 10 is open, the pressing chamber 3 is only partially enclosed.

Perforations 6 are provided in at least one wall of the pressing chamber 3. The perforations 6 preferably have a diameter of 12 mm or less, more preferably 8 mm or less. Optionally, perforations 6 can be provided in any one or more walls of the pressing chamber 3. For example, perforations 6 can also be provided in part of the frame 1 that provides the bottom wall of the pressing chamber 3, or in the face of the first plunger 4 that provides another end wall of the pressing chamber 3, or both. Preferably, at least some of the perforations 6 are located in end wall 9 or in the face of the first plunger 4. Perforations 6 in these surfaces are oriented parallel to the movement of the first plunger 4 and do not plug as often as perforations 6 in other walls of the pressing chamber 3.

The second plunger 12 can be moved between at least 2 positions. In the example shown, the second plunger 12 can be moved between 3 positions. In FIG. 14, the second plunger 12 is shown in a pressing position in which the front of the second plunger 12 is at location D. In an optional retracted position, the front of the second plunger 12 would be at location C. In an ejecting position, the front of the second plunger 12 would be at location E.

The first plunger 4 can also be moved between at least 2 positions. In FIG. 14, the first plunger 4 is shown in an ejecting position in which the front of the first plunger 4 is at location A. In a pressing position, the front of the first plunger is located at position B. Optionally, the first plunger 4 can be extended essentially up to the end wall 9. This full extension can be used when pressing waste that can all be converted into pressate. Full extension can also be used to periodically scrape clean the pressing chamber 3, particularly the front face of second plunger 12 and the inside surface of the sliding door 10.

In use, the press 100 operates through a repeated cycle of steps to press batches of waste. In a first step, waste is loaded into the pressing chamber 3. The second plunger 12 is retracted to position C and waste is dropped from above onto the frame 1 between the front of second plunger 12 and the pressing chamber 3. Then, with the first plunger 4 in position A and the sliding door 10 closed, the second plunger 12 advances from position C to position D. Preferably, the distance between position C and position D is greater than the distance across the pressing chamber 3 in the direction of motion of the second plunger 12. In this way, the waste is pre-compressed as it is loaded into the pressing chamber 3. Alternatively, waste can be pre-compressed in the pressing chamber 3 by repeating the second step a sufficient number of times.

In another option, waste could be loaded through the top or bottom of the pressing chamber 3. However, this is likely to weaken the frame 1 and could make it more difficult to use the second plunger 12 to pre-compress the waste. In yet another option, the waste could be loaded into pressing chamber 3 using the first plunger 4, but this is not preferred. First plunger 4 will be used to provide the final compression of the waste, preferably to a pressure of 50 bar or more, for example 180 bar. Accordingly, the first plunger 4 is driven by a powerful device such as a large diameter hydraulic piston. The time required to press a batch of waste, or the energy required to press a batch of waste, or both, are likely to increase with increased movement of the first plunger 4.

Even when pre-compressing material as described above, some types of waste are still not efficiently loaded into the pressing chamber 3. In these cases, the waste can also be compressed as it is being loaded onto the frame 1. For example, the waste can be pushed through a hopper that becomes narrower towards its exit. Alternatively, a flap or other mechanism can be used to press the waste onto the frame 1 rather than merely dropping the waste onto the frame 1 by force of gravity alone. Even when additional pre-compression is not required, using a flap to press waste onto the frame 1 in front of the second plunger 12 can be useful because it prevents long items, such as sticks and wire, from protruding upwards beyond the top of the second plunger 12. Although the second plunger 12 could be made strong enough to shear long items against the frame 1 as they are pushed into the pressing chamber 3, there is less risk of stopping production if long items are pushed down onto the frame 1 before pushing them into the pressing chamber 3.

In a second step, the waste is compressed. With the sliding door 10 closed and the second plunger 12 at position D, the first plunger 4 moves from position A to position B. As the waste is compressed, pressate is pushed through the perforations 6 and falls from the press 100. The precise location of position B may be predetermined based on design calculations to predict when the waste will reach a desired minimum pressure or degree of compaction. In some cases, position B could be near to or at the end wall 9. Alternatively, the first plunger 4 may be advanced until a specified pressure is reached in the pressing chamber 3. Optionally, the first plunger 4 may dwell in its advanced position for a period of time to allow liquids and small solid particles to travel through the waste to the perforations 6.

While the waste is being compressed, a substantial force is created against the second plunger 12. This force is resisted by sliding one or more locks 25 to the position shown in dashed lines in FIG. 14 behind the second plunger 12. Alternatively, one or more locks 25 could be slid into a notch in the second plunger 12. The lock 25 transfers force from the second plunger 12 to the frame 1. In this way, energy is not consumed holding the second plunger 12 in place while the waste is compressed.

In a third step, remaining waste is ejected from the pressing chamber 3. The first plunger 4 is retracted to position A and sliding door 10 is opened. Second plunger 12 is moved from position D to position E. The remaining waste is thereby ejected through the side of the pressing chamber. Alternatively, the first plunger 4 could eject the waste, but this is not preferred. As discussed above, it is preferable to avoid moving the first plunger 4 other than to compress the waste and retract in the second step. Energy consumption or time, or both, can be reduced by having the first plunger 4 travel only part way through the pressing chamber 3 when possible.

Preferably, the second plunger 12 scrapes waste from the top, bottom and end walls of the pressing chamber 3, including the front face of the first plunger 4, as it ejects the waste. The pressate, and similar material remaining in the pressing chamber 3, flows like a liquid only under the high pressures created within the pressing chamber 3. Once the pressure is released, the pressate acts like a solid. If allowed to dry, the pressate becomes extremely difficult to remove. Therefore, it is useful to have the second plunger 12 sweep through the pressing chamber 3 and remove substantially all of the remaining waste from the pressing chamber 3 and the front of the first plunger 4. From time to time, for example before turning the press 100 off for a period of time, a scraping sweep with the second plunger 12 can be followed by sweeping the first plunger 4 through the entire pressing chamber 3 to scrape waste from the inside of the sliding door 10 and the front of the second plunger 12. Waste removed by the first plunger 4 in this way may be pressed trough the perforations 6 in end wall 9 or compacted against the end wall 9 so that one more sweep with the second plunger 12 can substantially clean the pressing chamber 3. In the more detailed examples to be described further below, the outside surface of any wall with perforations 6 is also scraped, preferably in every cycle, to remove pressate from these surfaces.

The sliding door 10 covers a side of the pressing chamber 3 that is essentially the same size and shape as the front of the second plunger 12. This helps the second plunger 12 clean out the pressing chamber 3 as described above. Even though most waste is sorted to some extent, the waste can still sometimes contain large incompressible pieces such as bricks or metal. These items can block the first plunger 4 from reaching its expected position or pressure, and so the process stops and the first plunger 4 must be retracted. With a large sliding door 10 and second plunger 12 that can sweep through the entire pressing chamber 3, almost anything that entered the pressing chamber 3 can be removed and the press 100 can return to production quickly.

The press 100 may be used in a process for treating organic waste. As the first plunger 4 advances into the pressing chamber 3, a pressate is forced out of the press 100 through perforations 6. Preferably, the pressure applied to the organic waste is 50 bar or more, which causes cells in the organic waste to burst. The pressate includes liquid from within the cells, liquid from the organic waste generally, and solids suspended or dissolved in these liquids. Despite the presence of some liquid, the pressate typically has a high solids concentration and is handled as a biosolid. For example, the pressate may drop from the press 100 to a screw auger or conveyor belt to be carried away from the press 100. The pressate may be loaded into an anaerobic digester for further treatment.

The press 100 may be used to provide the extrusion press in a device or process as described in US Publication No. US 2013/0316428 A1, Process for the Production of Fuel Gas from Municipal Solid Waste. US 2013/0316428 A1 is incorporated herein by reference. International application No. PCT/NL2014/000026 is also incorporated herein by reference.

FIGS. 1 to 13 describe four examples of presses 100 in greater detail. These presses (FIGS. 2 to 13) operate according to the principles described above. These presses may also have one or more additional features. In some aspects, FIGS. 1 to 13 show devices for pressing organic material out of waste having, a pressing chamber; a first pressing member for compacting introduced waste; a first feed opening for feeding waste into the pressing chamber; perforations for allowing air, moisture and organic material pressed out of introduced waste to escape from the pressing chamber, which perforations are arranged in a wall of the pressing chamber and debouch in a surface bounding the pressing chamber; and, a discharge opening for discharging from the pressing chamber compacted waste from which air, moisture and organic material are at least partially removed. These devices are characterized in that the surface lies perpendicularly of the pressing direction of the first pressing member. Pressing perpendicularly of the surface can be, in some cases, more effective and efficient pressing.

The term 'perpendicularly' and related terms are understood in the context of the invention to mean 'at least substantially perpendicularly'. Pressing perpendicularly of the surface can, in some cases, result in a more effective and efficient pressing. Perforations can also be arranged here in the first pressing member. Preferably, there are perforations in both the fixed wall and the first pressing member. The first pressing member preferably comprises a first plunger. Using a plunger, in contrast to for instance an auger, the pressure in the pressing chamber and the compacted material can be properly controlled and a high pressure can be readily realized.

The device preferably also comprises a second pressing member, more preferably a second plunger, for discharging compacted waste from the pressing chamber through the discharge opening. The pressing direction of the second pressing member preferably lies perpendicularly of the pressing direction of the first pressing member and the cross-section of the second pressing member is the same as the cross-section of the discharge opening. The term 'the same' and similar terms are understood in the context of the invention to mean 'at least substantially the same'. The term 'cross-section' is understood here to mean 'the active cross-section perpendicularly of the direction of movement'. It is thus found that the discharge of compacted material can take place simply with only a small chance of malfunctions, for instance due to larger pieces of solid material becoming jammed in the device.

These devices preferably also have, a second feed opening for feeding waste into the device; and, an infeed chamber, which infeed chamber is located between the first feed opening and the second feed opening.

In a first extreme position of the first pressing member the infeed chamber can be situated here between the pressing surface of the first pressing member and the first feed opening. Waste fed into the infeed chamber can then be displaced by means of the second pressing member via the first feed opening to the pressing chamber and there subsequently compacted by means of the first pressing member. In a first extreme position of the second pressing member the infeed chamber can also be situated between the pressing surface of the second pressing member and the first feed opening. Waste fed into the infeed chamber can then be displaced by means of the second pressing member via the first feed opening to the pressing chamber and there subsequently compacted by means of the first pressing member. The term 'pressing surface' is understood in the context of the invention to mean 'the part of the periphery exerting pressure on the relevant material during pressing or displacement'. 'Between the pressing surface of a pressing member and a feed opening' is understood here to mean 'between a first plane in which the pressing surface lies and a second plane in which the feed opening lines'. A pre-compaction takes place during the displacement of waste fed into the infeed chamber to the pressing chamber via the first feed opening. In some cases, this may further increase the effectiveness, efficiency and yield of the pressing.

The device (100) shown in FIG. 1 comprises a second feed opening (2) for feeding waste into device (100), an infeed chamber (13), a pressing chamber (3) and a first pressing member, here a first plunger (4), for compacting introduced waste, and a first feed opening for feeding waste into pressing chamber (3). In order to allow air, moisture and organic material pressed out of introduced waste to escape from pressing chamber (3) perforations are arranged in a wall (9) of pressing chamber (3). Perforations (6) debouch in a surface bounding pressing chamber (3). Characteristic is the position of this surface (7) perpendicularly of the pressing direction of first pressing member (4). Perforations (6) are also arranged in first plunger (4).

First plunger (4) is movable between two extreme positions by means of a drive, here a first hydraulic cylinder (15).

In the first extreme position (shown in FIG. 1) infeed chamber (13) is situated between pressing surface (11) of first plunger (4) and first feed opening (5). The waste to be compacted can now be fed via the second feed opening (2) into device (100). First plunger (4) can be moved (to the right in FIG. 1) to the second extreme position in which pressing surface (11) is situated in pressing chamber (3) (not shown) and first plunger (4) closes second feed opening (2). In this movement the waste to be compacted is fed into pressing chamber (3) via first feed opening (5), pre-compacted and further compacted in pressing chamber (3).

Device (100) also comprises a discharge opening (8) for discharging compacted waste from pressing chamber (3). Discharge opening (8) can be closed by means of a first door, here a sliding door (10). Device (100) also comprises a second pressing member, here a second plunger (12), movable by means of a drive, here a second hydraulic cylinder (16), for discharging compacted waste out of pressing chamber (3) through discharge opening (8). The pressing direction of second plunger (12) lies perpendicularly here of the pressing direction of first plunger (4). Second plunger (12) is movable between two extreme positions, a first extreme position (shown in FIG. 1) in which pressing surface (21) is situated just outside pressing chamber (3) and bounds pressing chamber (3), and a second extreme position (not shown) wherein pressing surface (21) is situated at the position of discharge opening (8). In the movement from the first extreme position to the second extreme position material compacted in pressing chamber (3), following opening of sliding door (10), is discharged from pressing chamber (3) via discharge opening (8).

The device (200) shown in FIGS. 2-5 again comprises a second feed opening (2), provided here with a hopper (20), for feeding waste into device (200), an infeed chamber (13), a pressing chamber (3) and a first pressing member, here again a first plunger (4), for compacting introduced waste, a first feed opening (5) for feeding waste into pressing chamber (3), and a second pressing member, here again a second plunger (12), for discharging compacted waste from pressing chamber (3) through a discharge opening (8). The pressing direction of second plunger (12) again lies perpendicularly here of the pressing direction of first plunger (4). In order to allow air, moisture and organic material pressed from introduced waste to escape from pressing chamber (3) perforations (6) are once again arranged in a wall (9) of pressing chamber (3) and in first plunger (4). Second feed opening (2), first feed opening (5) and infeed chamber (13) are however now situated at other locations.

First plunger (4) is again movable by means of a drive, here again a first hydraulic cylinder (15), again between two extreme positions. In the first extreme position (shown in FIG. 5) the pressing surface (11) is now situated just outside the pressing chamber (3) and pressing surface (11) bounds pressing chamber (3). In the second extreme position (not shown) the pressing surface (11) is again situated inside pressing chamber (3). In the movement from the first extreme position to the second extreme position the introduced waste is compacted in pressing chamber (3). The stroke made my first plunger (4) is now minimal, which has advantages in respect of for instance simplicity of construction, processing capacity, wear and the space and energy required.

Discharge opening (8) can again be closed by means of a first door, here again a sliding door (10), driven here by means of a third hydraulic cylinder (22). Second plunger (12) is again movable between two extreme positions. In a first extreme position (shown in FIG. 4) infeed chamber (13) is now situated between pressing surface (21) of second plunger (12) and first feed opening (5). The waste to be compacted can again now be fed via second feed opening (2) into device (200). In an intermediate position between the two extreme positions (not shown) pressing surface (21) is situated at the position of first feed opening (5). In the movement from the first extreme position to the intermediate position waste to be compacted is now carried by means of second plunger (12) via first feed opening (5) into pressing chamber (3) and thereby pre-compacted. The introduced waste can now be compacted by means of first plunger (4) wherein pressing surface (21) of second plunger (12) bounds pressing chamber (3). In the second extreme position (not shown) of second plunger (12) the pressing surface (21) is again situated at the position of discharge opening (8). In the movement from the intermediate to the second extreme position material compacted in pressing chamber (3) is once again discharged via discharge opening (8) out of pressing chamber (3) following opening of sliding door (10). The position of second plunger (12) in the intermediate position has to be well-defined. This is possible for instance by fixing second plunger (12) in this intermediate position within the applicable tolerances by means of a locking (not shown) provided for this purpose, for instance in the form of pins and receiving spaces co-acting therewith. The extreme positions of plungers (4, 12) are in principle easier to define, for instance by having the plungers (4, 12) come up against stops provided for this purpose in the extreme positions, this in a manner as will be apparent to a skilled person.

Figure 5:
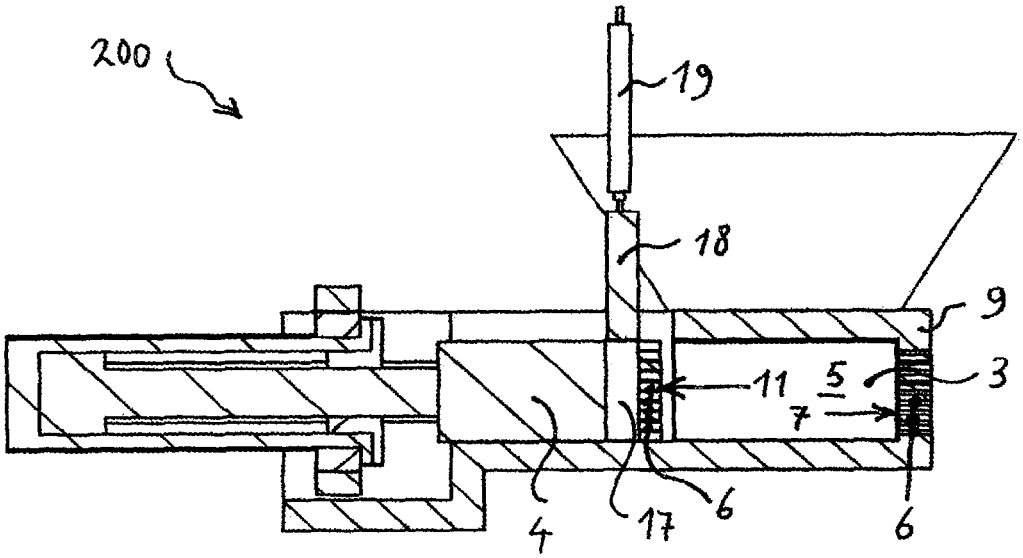
FIG. 5 is a vertical section of the Press of FIG. 2 along the plane B-B.
Figure 6:
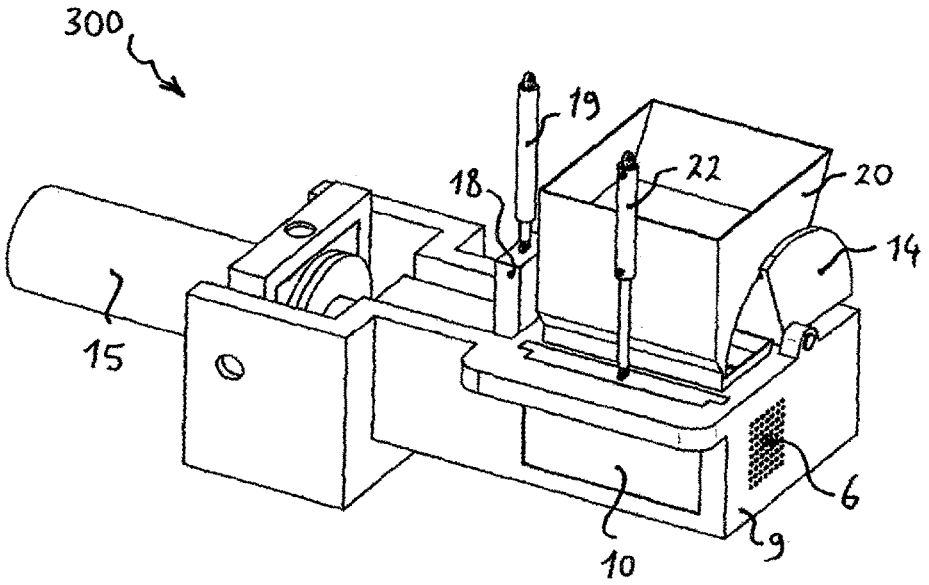
FIG. 6 shows a perspective view of a third press.
Figure 7:
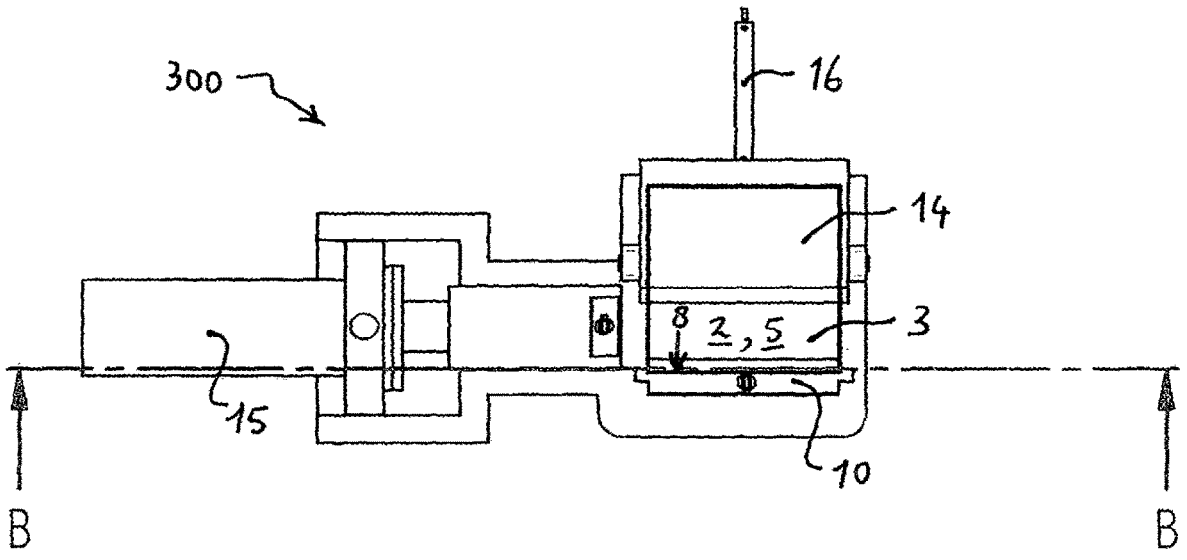
FIG. 7 is a top view of the press of FIG. 6.
Figure 8:
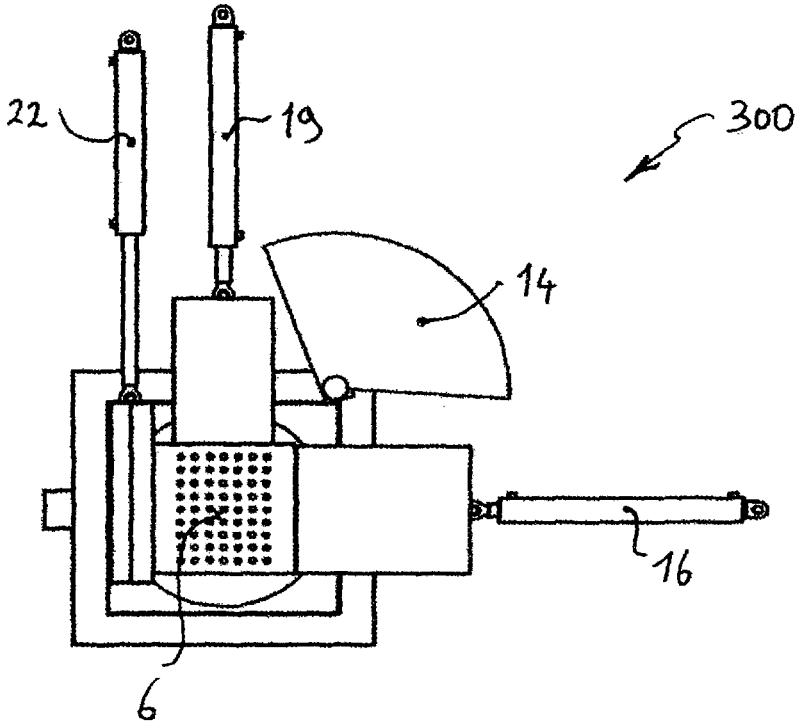
FIG. 8 is a side view of the press of FIG. 6.
Figure 9:
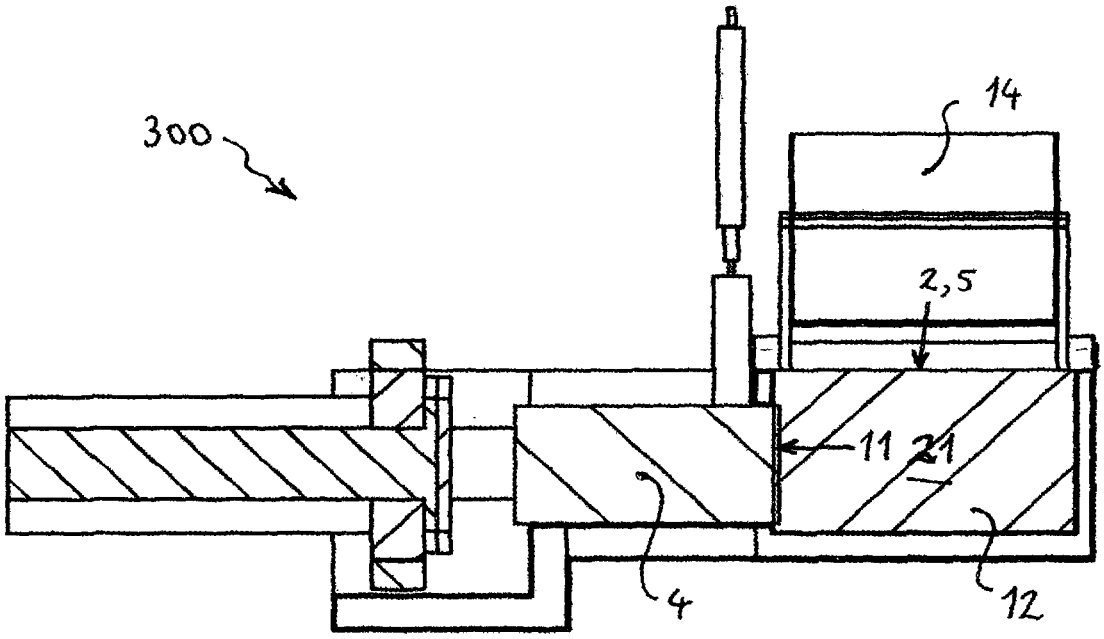
FIG. 9 is a vertical section of the press of FIG. 6 along the plane B-B.
Figure 10:
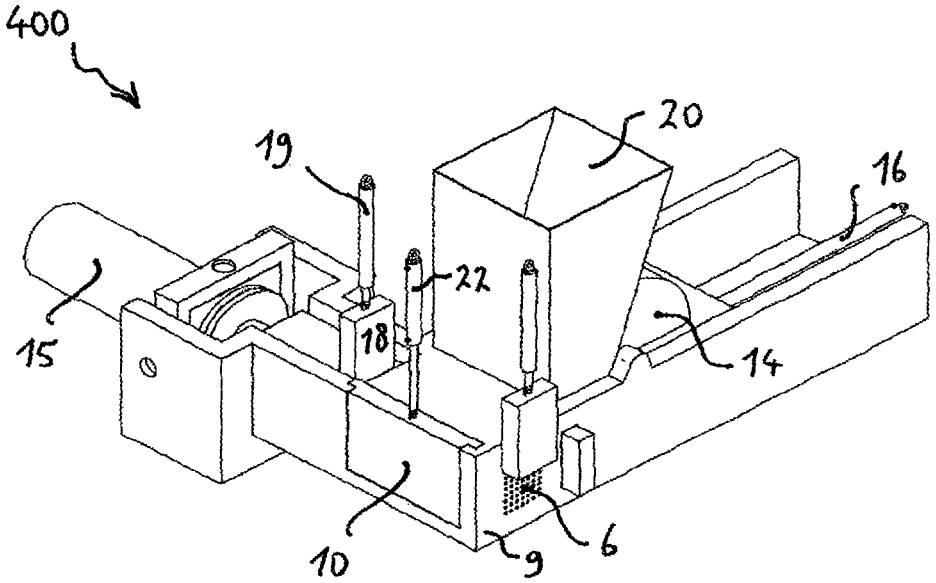
FIG. 10 shows a perspective view of a fourth press.
Figure 11:
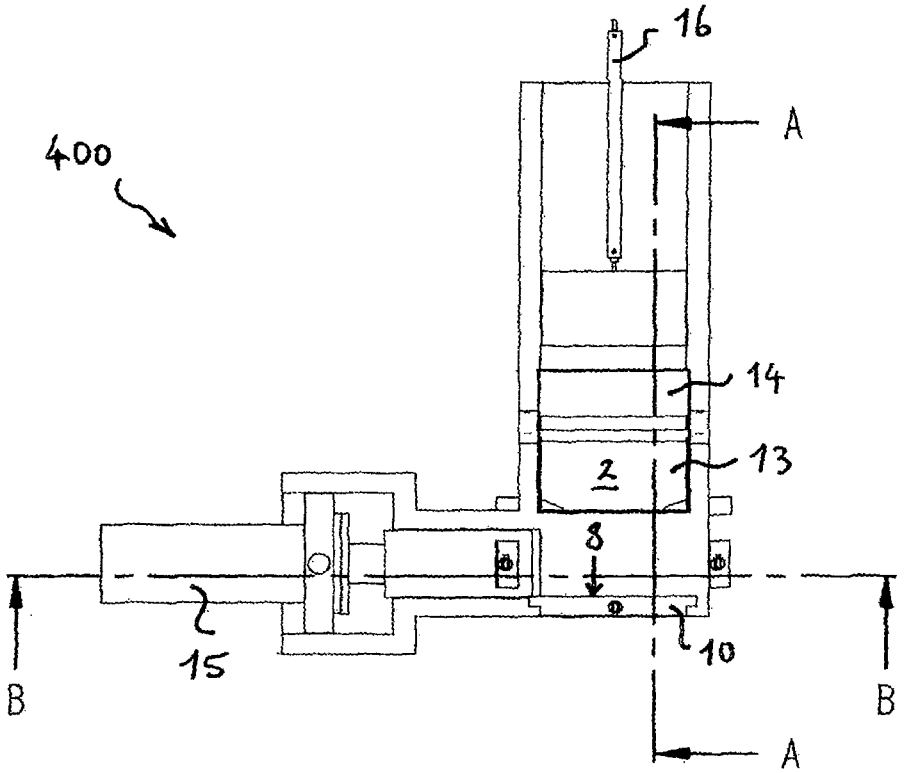
FIG. 11 is a top view of the press of FIG. 10.
Figure 12:
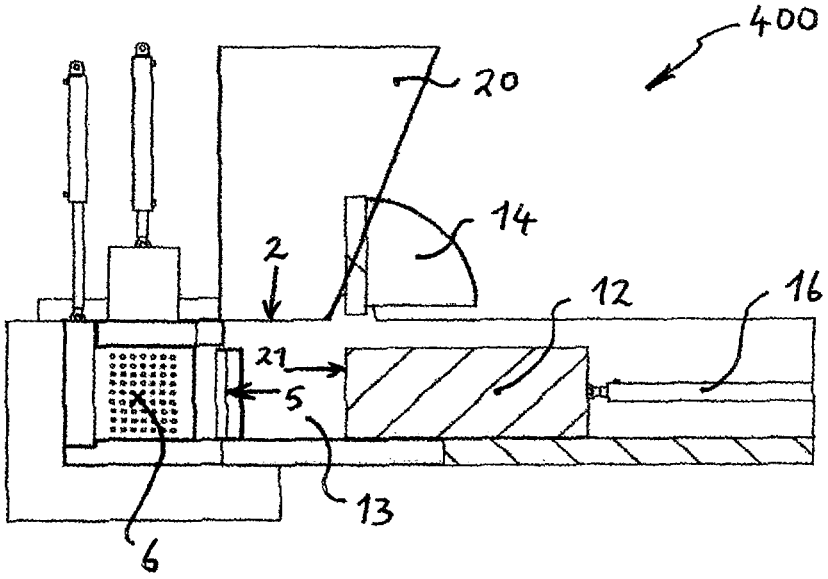
FIG. 12 is a vertical section of the press of FIG. 10 along the plane A-A.
Figure 13:
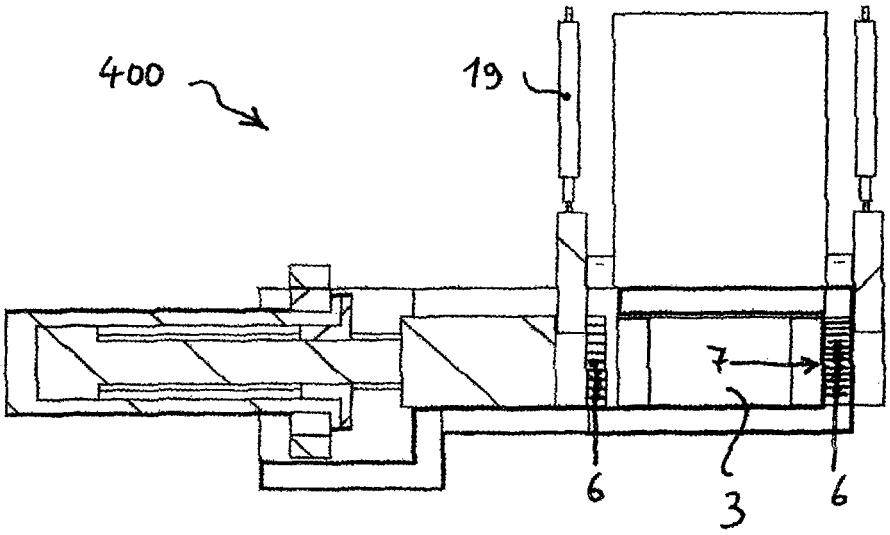
FIG. 13 is a vertical section of the press of FIG. 10 along the plane B-B.

The cross-section, i.e. the active cross-section perpendicularly of the direction of movement, of second plunger (12) is the same as the cross-section of discharge opening (8). All waste compacted in pressing chamber (3) can in principle thus be removed from pressing chamber (3) via discharge opening (8) by means of second plunger (12) when sliding door (10) is opened and first plunger (4) is in its first extreme position (as shown in FIG. 5). There is very little chance here of objects becoming jammed in device (200) or pressing chamber (3).

Device (200) also comprises a provision, here a slide (18) driven by means of a fourth hydraulic cylinder (19), for discharging pressed-out organic material, present here in a space (17) provided for this purpose in first plunger (4). Slide 18 and fourth hydraulic cylinder 19 also scrape pressate from the back side of perforations 6 of first plunger (4). Device (200) can comprise more of such provisions (not shown), for instance also for the purpose of removing pressed-out material in the vicinity of the perforated wall (9).

Device (300) shown in FIGS. 6-9 once again comprises the same components as devices (100; 200) shown in FIGS. 1-5. Second feed opening (2) and first feed opening (5) now however coincide and are now situated at another location, i.e. immediately above pressing chamber (3), and bound pressing chamber (3). It could also be stated that the volume of the infeed chamber is now zero. The strokes made by first plunger (4) and second plunger (12) are now both minimal, which again has advantages, for instance in respect of simplicity of construction, processing capacity, wear and the space and energy required. Device (300) now also comprises a second door for opening and closing the combined feed opening (2,5), here a pivoting door (14), although this can for instance again be a sliding door. A pivoting door is generally recommended because parts protruding outside pressing chamber (3) are hereby pushed inward during closing of door (14) and cannot therefore become jammed during the movement of second plunger (12). A partial pre-compaction also takes place here.

Device (400) shown in FIGS. 10-13 again comprises the same components as devices (100; 200; 300) shown in FIGS. 1-9. Second feed opening (2), first feed opening (5) and infeed chamber (13) are again now situated at other locations. In the first extreme position (shown in FIG. 12) infeed chamber (13) is now situated between pressing surface (21) of second plunger (12) and first feed opening (5). By means of second plunger (12) the waste fed via second feed opening (2) into infeed chamber (13) is fed through further to pressing chamber (3) via first feed opening (5), and again pre-compacted here. Device (300) also again comprises a second door, now for opening and closing the second feed opening (2), here again a pivoting door (14). During closing of the door (14) parts protruding outside infeed chamber (13) are again pushed inward so that they cannot become jammed during the movement of second plunger (12). A partial pre-compaction again also takes place here.

Device 400 also has second a slide (18) driven by means of another fourth hydraulic cylinder (19), to scrape pressate from the back side of perforations 6 in frame 1. A first slide 18 scrapes pressate from the back of perforations 6 in the first plunger 4. Device 400 also has a lock 25 that can slide in a whole in the frame 1. The lock 25 can be selectively slid into indentation (not shown) in second plunger 12 to hold second plunger 12 in place while first plunger 4 compresses the waste.

In a device (200; 400) according to the invention comprising an infeed chamber (13) 30 located between second feed opening (2) and the first feed opening the waste is not fed directly into pressing chamber (3) but via infeed chamber (13). In addition to the stated advantages of pre-compaction and limiting the stroke required by first plunger (4), this also has structural advantages. The walls of pressing chamber (3) then have fewer openings, whereby they can better absorb the great forces exerted thereon.

Operation with a device (100; 200; 300; 400) according to the invention can take place as 5 follows. Perforations (6) have for instance a size of 4 to 8 mm. When during pressing a desired final pressure of for instance 50 bar or more, 100 bar or more or between 200-300 bar has been reached, first plunger (4) can be moved back. Discharge opening (8) can subsequently be opened by sliding away the sliding door (10) present in a side wall of pressing chamber (3). The remaining solid material can then be pressed out of pressing chamber (3) from an opposite side wall of 10 pressing chamber (3) by means of second plunger (12). Plungers (4, 12) then return to their rest positions (first extreme positions) and sliding door (10) is closed for the following cycle. The organic material pressed through perforations (6) is collected and carried away, optionally using additional plungers or slides.

Owing to the relatively high pressure, whereby the cell walls break and the organic material becomes more pasty and fluid, but also due to pressing through the relatively small perforations (6), very few interfering substances will be present in the pressed-out material. Stainless steel objects, such as knives and forks, which cannot be removed in a magnetic pre-processing, will thus not appear in the pressed-out material. The pressed-out material will also be greatly reduced in size as it passes through the relatively small perforations, and the proportion of glass and sand will decrease, as will the proportion of plastics. As a result of all this it will be possible to digest the pressed-out material more easily, completely and rapidly compared to un-pressed waste. Further, downtime caused by interfering substances is limited.

What remains in the pressing chamber after pressing is largely free of organic material and moisture. The remaining material has a greatly reduced moisture content, whereby the calorific value is greatly increased. Because the remaining material is relatively dry, it can also be further separated more easily since dry material adheres less than moist material.

Owing to the relatively simple construction with a pressing chamber that is wholly closed during pressing and with few moving parts, the device is robust. It has also become easy to replace wearing parts, such as the perforated parts. The drives and guides of the plungers are loaded less than in some other devices.

It will be apparent that the invention is not limited to the shown and described exemplary presses but that diverse variants which may appear to a skilled person are possible within the scope of the invention. In addition to being used for pressing organic material out of waste, the invention can also be applied for pressing another softer, more deformable or liquid fraction from a mixture also comprising a more solid and less deformable fraction.

I claim:

1. A press, comprising:

a frame having walls that partially enclose a pressing chamber having a discharge opening and an infeed chamber connected to the pressing chamber via a feed opening; and first and second plungers mounted in the press such that they are perpendicular to each other and have at least partially overlapping strokes, each stroke including movement in a first direction and a second direction;

wherein the second plunger is movable through the infeed chamber such that waste in the infeed chamber is pushed through the feed opening into the pressing chamber, and is movable through the entire pressing chamber such that the waste in the pressing chamber is discharged from the pressing chamber through the discharge opening and such that the stroke of the second plunger sweeps across a face of the first plunger;

wherein the first plunger is movable into the pressing chamber such that the waste in the pressing chamber is compressed and such that the stroke of the first plunger sweeps across at least a portion of a face of the second plunger; and a lock associated with the frame and configured for slidably engaging a rectangular cross section of the second plunger to prevent movement of the second plunger in at least one direction.

2. The press of claim 1 wherein the first plunger has a rectangular cross section.

3. The press of claim 1, wherein the pressing chamber has a rectangular cross section that is as wide as the first plunger on one side of the rectangle, and as wide as the second plunger on the other side of the rectangle.

4. The press of claim 1, further comprising a door selectively closing the discharge opening of the pressing chamber opposed to the second plunger.

5. The press of claim 1, further comprising:

perforations, which perforations are arranged in at least one of the walls enclosing the pressing chamber for allowing air, moisture, and organic material pressed out of introduced municipal solid waste to debouch out of the pressing chamber through a surface bounding the pressing chamber;

a feed hopper in communication with the feed opening; and, a door, wherein the door pivots through the feed hopper and closes the feed opening, wherein the second plunger is movable to partially enclose the pressing chamber.

6. The press of claim 5, wherein a cross-section of the second plunger is the same as the cross-section of the discharge opening.

7. The press of claim 5, wherein the door is vertically aligned with and above the second plunger.

8. The press of claim 1, wherein the first plunger exerts a higher pressure on the waste than the second plunger.

9. The press of claim 8, wherein the first plunger exerts a pressure of at least 50 bar on the waste.

10. A method for pressing municipal solid waste by a device comprising:

a pressing chamber and a first pressing member for compacting introduced municipal solid waste, the first pressing member movable through the pressing chamber towards an end wall of the pressing chamber;

a second pressing member that is perpendicular to the first pressing member;

a first feed opening for feeding the introduced municipal solid waste into the pressing chamber;

perforations arranged in a wall of the pressing chamber for allowing air, moisture and organic material pressed out of introduced municipal solid waste to debouch out of the pressing chamber through a surface bounding the pressing chamber; and a discharge opening for discharging from the pressing chamber compacted waste from which air, moisture and organic material are at least partially removed; and a lock configured for slidably engaging a rectangular cross section of the second pressing member;

the method comprising steps of:

feeding the introduced municipal solid waste via the first feed opening into the pressing chamber with the second pressing member;

sliding the lock relative to the second pressing member such that movement of the second pressing member is prevented in at least one direction;

compacting the introduced municipal solid waste in the pressing chamber by moving the first pressing member into the pressing chamber and sweeping across at least a portion of a face of the second pressing member;

allowing air, moisture and organic material pressed out of introduced municipal solid waste to escape from the pressing chamber via the perforations; and discharging compacted waste from the pressing chamber via the discharge opening by moving the second pressing member through the entire pressing chamber such that the stroke of the second pressing member sweeps across a face of the first pressing member, wherein compacting takes place perpendicularly of the surface by the first pressing member.

11. The method of claim 10, wherein the device also comprises:

a second feed opening for the introduced municipal solid waste into the device; and an infeed chamber, which infeed chamber is located between the first feed opening and the second feed opening, and wherein in a first extreme position of the second pressing member the infeed chamber is situated between a pressing surface of the second pressing member and the first feed opening wherein the method further comprises:

feeding the introduced municipal solid waste into the infeed chamber via the second feed opening; and displacing the introduced municipal solid waste fed into the infeed chamber to the pressing chamber via the first feed opening by the second pressing member.

* * * * *